US005474039A

United States Patent [19]

Döragrip

[11] Patent Number: 5,474,039

[45] Date of Patent: Dec. 12, 1995

[54] INLET TUBE FOR AN INTERNAL COMBUSTION ENGINE

[75] Inventor: Fridolf A. G. Döragrip, Tenhult, Sweden

[73] Assignee: Aktiebolaget Electrolux, Stockholm, Sweden

[21] Appl. No.: 312,606

[22] Filed: Sep. 27, 1994

[30] Foreign Application Priority Data

Oct. 21, 1993 [SE] Sweden ..... 9303470

[51] Int. Cl.[6] ..... F02M 29/00

[52] U.S. Cl. ..... 123/184.55; 123/184.61

[58] Field of Search ..... 123/73 C, 73 AD, 123/184.61, 73 A, 184.55, 184.56, 184.53, 184.22, 184.23, 184.39, 184.46

[56] References Cited

U.S. PATENT DOCUMENTS 4,711,225 12/1987 Holderle et al. ..... 123/184.61
4,835,866 6/1989 Nagashima et al. ..... 123/73 AD
4,903,644 2/1990 Groger et al. ..... 123/184.61
5,065,708 11/1991 Wehle et al. ..... 123/73 C

*Primary Examiner*—Marguerite Macy
*Attorney, Agent, or Firm*—Pearne, Gordon, McCoy & Granger

[57] ABSTRACT

An inlet tube (13) for interconnecting a carbureter (11) and an inlet pipe socket (12) of an internal combustion engine, especially in a motor saw, is made of a flexible material and provided with a bellows (16) for allowing relative movement between the carbureter and the engine. In order to prevent accumulation of fuel in the bellows, a telescopically slidable tube piece (17) is provided radially inside the bellows. The tube piece has an outer sealing surface cooperating with a complementary, surrounding sealing surface of the inlet pipe socket (12) in order to isolate the bellows from the interior of the inlet tube. The bellows is arranged adjacent to the intake pipe socket (12) in order to evaporate any liquid fuel accumulated in the bellows by heat supplied by said intake pipe socket.

1 Claim, 1 Drawing Sheet

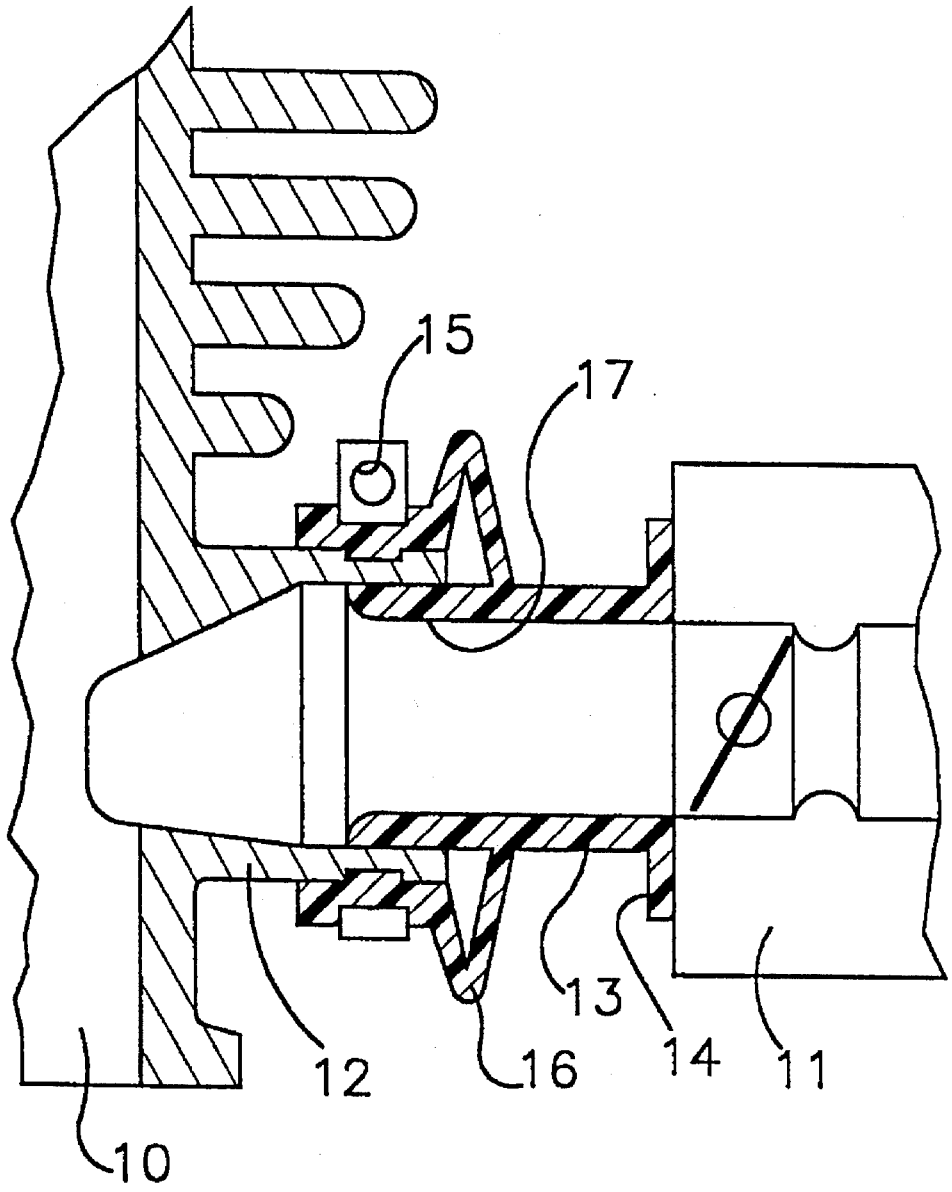
15
17
13
12
16
14
11
10

INLET TUBE FOR AN INTERNAL COMBUSTION ENGINE

BACKGROUND OF THE INVENTION

The present invention relates to an inlet tube for interconnecting a carburetor and an intake pipe socket of an internal combustion engine, especially in a motor saw, wherein the inlet tube is made of a flexible material and provided with a bellows for allowing relative movement between the carburetor and the engine The invention further relates to such an inlet tube having a telescopically slidable tube piece provided radially inside the bellows, wherein the tube piece has an outer sealing surface cooperating with a complementary, surrounding sealing surface in order to screen off the bellows from the interior of the inlet tube.

In motor saws, in order to prevent transmission of vibrations from the engine to the carburetor, flexible inlet tubes are used. The inlet tubes are preferably made of rubber and are provided with some kind of bellows arrangement in order to allow sufficient relative movements. In addition to the vibration insolation, such an inlet tube also provides a favorable thermal insulation. The disadvantage is, however, that liquid fuel tends to accumulate in the bellows when the engine is running at idling speed. Under certain operational conditions such liquid fuel may be sucked into the the engine and result in disturbance or interruption of the operation.

SUMMARY OF THE INVENTION

It is the object of the present invention to solve the problem of fuel accumulation encountered in the prior art, and to provide an inlet tube by which the risk of disturbance of operation has been reduced or eliminated. This has been achieved by means of an improved inlet tube wherein the bellows is arranged or provided adjacent to the intake pipe socket in order to evaporate any liquid fuel accumulated in the bellows by heat supplied by the intake pipe socket.

BRIEF DESCRIPTION OF THE DRAWING

The invention will be described in more detail in the following with reference to the accompanying drawing which illustrates a longitudinal section of the inlet tube according to the invention.

DETAILED DESCRIPTION OF THE PREFERRED EMBODIMENT

In the drawing, a portion of a cylinder 10 of an internal combustion engine, and a portion of a carburetor 11, are shown diagrammatically. The cylinder 10 is provided with an intake pipe socket 12. The carburetor 11 is connected to the intake pipe socket by means of an inlet tube 13 made from an elastic material, preferably rubber. An end of the inlet tube 13 facing the carburetor 11 is provided with a radially-outwardly extending flange or collar 14 by which the inlet tube 13 is connected to the carburetor 17 via by attachment means (not shown). An opposite of the inlet tube 11 facing the cylinder 10 is secured to an exterior or radially outer surface of the intake pipe socket 12 by means of a clamp 15.

As can be seen in the drawing, the inlet tube 13 is provided adjacent to the cylinder end 1 thereof with a bellows 16 permitting the carburetor 11 to move relative to the cylinder 10. The inlet tube 13 has a tube portion 17 extending into the intake pipe socket 12 to be connected to the inside thereof whereby a telescopically movable sealing is provided. The interior of the bellows 16 is thereby screened off from the intake passage to the engine formed by the intake tube 13, and consequently, introduction and collection of fuel in the bellows 16 is generally prevented.

As is apparent in the drawing, the end of the intake pipe socket 12 extends into the interior of the bellows 16. Due to the relatively high temperature of the intake pipe socket 12, any liquid fuel leaking into the bellows 16 will be evaporated by the heat provided by the intake pipe socket 12. The risk of accumulation of liquid fuel in the bellows is thereby still further reduced.

I claim:

1. Inlet tube for interconnecting a carburetor (11) and an intake pipe socket (12) of an internal combustion engine, said inlet tube being made of a flexible material and including a bellows (16) which allows relative movement between the carburetor and the engine, said inlet tube also having a telescopically slidable tube piece (17) radially inside the bellows, said tube piece having an outer sealing surface cooperating with a complementary, surrounding sealing surface of the intake pipe socket in order to separate the bellows from the interior of the inlet tube, wherein the bellows is in direct engagement with the intake pipe socket (12) in order to evaporate any liquid fuel which accumulates in the bellows by heat supplied by said intake pipe socket.

* * * * *